US005930836A

United States Patent [19]

Morris

[11] Patent Number: 5,930,836

[45] Date of Patent: Aug. 3, 1999

[54] ADJUSTABLE REUSABLE DISPOSABLE BIB

[76] Inventor: Bert Morris, 465 La Corso Cir., Walnut Creek, Calif. 94598-2237

[21] Appl. No.: 09/055,066

[22] Filed: Apr. 3, 1998

Related U.S. Application Data

[60] Provisional application No. 60/042,657, Apr. 4, 1997.

[51] Int. Cl.[6] ..... A41B 13/00; A41B 13/10

[52] U.S. Cl. ..... 2/49.1; 2/49.2; 2/52

[58] Field of Search ..... 2/48, 49.1, 49.2, 2/49.3, 49.4, 49.5, 50, 51, 52

[56] References Cited

U.S. PATENT DOCUMENTS

| | | | |
|---|---|---|---|
| D. 232,134 | 7/1974 | Andersson . | |
| 1,898,950 | 2/1933 | Goldberger . | |
| 2,763,867 | 9/1956 | Chagnon . | |
| 2,782,420 | 2/1957 | Barager . | |
| 3,001,646 | 9/1961 | Cooper | 206/58 |
| 3,146,465 | 9/1964 | Hummel . | |
| 3,328,807 | 7/1967 | Strauss | 2/49 |
| 3,332,547 | 7/1967 | Rowe et al. . | |
| 3,416,157 | 12/1968 | Marder et al. | 2/49 |
| 3,452,363 | 7/1969 | Schultz | 2/49 |
| 3,857,116 | 12/1974 | Meeker | 2/50 |
| 3,945,048 | 3/1976 | Shearer | 2/49 |
| 3,979,776 | 9/1976 | Gruenwald | 2/49 |
| 3,995,321 | 12/1976 | Johnson | 2/49 |
| 3,999,221 | 12/1976 | Hannigan | 2/49 |
| 4,038,697 | 8/1977 | Levitt | 2/49 |
| 4,114,199 | 9/1978 | Malan | 2/49 |
| 4,171,542 | 10/1979 | Cox et al. | 2/51 |
| 4,186,443 | 2/1980 | Britzman | 2/49 |
| 4,225,977 | 10/1980 | Smith . | |
| 4,233,688 | 11/1980 | Hjerl . | |
| 4,261,057 | 4/1981 | Andersson | 2/49 |
| 4,288,877 | 9/1981 | Klepfer | 2/48 |
| 4,306,316 | 12/1981 | Klepfer | 2/48 |
| 4,330,888 | 5/1982 | Klepfer | 2/48 |
| 4,416,025 | 11/1983 | Moret et al. | 2/49 |
| 4,423,523 | 1/1984 | Bodner et al. | 2/49 |
| 4,441,212 | 4/1984 | Ahr et al. | 2/49 |
| 4,442,552 | 4/1984 | Bolick et al. | 2/49 |
| 4,445,231 | 5/1984 | Noel | 2/49 |
| 4,475,250 | 10/1984 | Savin et al. | 2/49 |
| 4,495,658 | 1/1985 | Moret et al. | 2/49 |
| 4,523,333 | 6/1985 | Spangler | 2/49 |
| 4,523,334 | 6/1985 | Lavash | 2/49 |
| 4,543,668 | 10/1985 | Franklin | 2/48 |
| 4,601,065 | 7/1986 | Sigl et al. | 2/49 |
| 4,620,323 | 11/1986 | Tepper | 2/49 |
| 4,622,698 | 11/1986 | Heyman et al. | 2/49 |
| 4,646,364 | 3/1987 | O'Larey . | |
| 4,646,365 | 3/1987 | Suprise et al. | 2/49 |
| 4,649,572 | 3/1987 | Roessler | 2/49 |
| 4,660,224 | 4/1987 | Ashcraft | 2/48 |
| 4,660,226 | 4/1987 | Quilling et al. | 2/49 |
| 4,706,303 | 11/1987 | Van Gompel et al. | 2/49 |
| 4,710,190 | 12/1987 | Wood et al. | 604/389 |
| 4,733,411 | 3/1988 | Foti | 2/49 |
| 4,754,500 | 7/1988 | Brucato et al. | 2/105 |
| 4,779,288 | 10/1988 | Mack | 2/49 |
| 4,780,911 | 11/1988 | Mack | 2/49 |
| 4,787,099 | 11/1988 | Mack | 2/49 |

(List continued on next page.)

*Primary Examiner*—John J. Calvert
*Assistant Examiner*—Shirra L. Jenkins

[57] ABSTRACT

This bib is designed to use the infrastructure already in place for the production, packaging, distribution, retailing and dispensing of a paper towel. A suggested bib material is a layer of paper toweling for absorbency with a plastic film backing for moisture protection. A suggested packaging is a roll of rectangular-shaped bibs having the same diameter and width as a roll of paper toweling. This enables the bib to be produced with existing technology and results in a roll of bibs that fits a standard paper towel holder and dispenses bibs in the same tear-off manner. The bib features a reusable attachment at the neck that accommodates different neck sizes and desired closeness of fit yet releases easily to eliminate a choking hazard. This also allows one size to fit children and adults. The bib also features a fold-up pocket at the bottom to catch and retain solid and liquid spills. These features plus the easy on, easy off and reusability add up to a low-cost, high performance product.

14 Claims, 3 Drawing Sheets

U.S. PATENT DOCUMENTS

Figure 8:
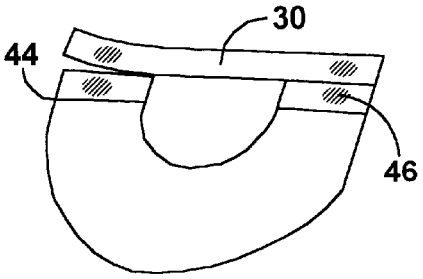

| | | | |
|---|---|---|---|
| 4,793,004 | 12/1988 | Long et al. | 2/49 |
| 4,797,952 | 1/1989 | Petrini | 2/49 |
| 4,811,428 | 3/1989 | Waldman et al. | 2/49 |
| 4,884,299 | 12/1989 | Rose | 2/49 |
| 4,887,315 | 12/1989 | Bezdek | 2/49 |
| 4,905,714 | 3/1990 | Drennen | 128/878 |
| 4,924,527 | 5/1990 | Hintermeyer | 2/49 |
| 4,951,318 | 8/1990 | Harreld et al. . | |
| 4,975,982 | 12/1990 | Hughes | 2/49 |
| 4,991,233 | 2/1991 | Hall | 2/115 |
| 5,008,960 | 4/1991 | Hemming | 2/104 |
| 5,062,158 | 11/1991 | Oka et al. | 2/46 |
| 5,075,897 | 12/1991 | Daniels | 2/2 |
| 5,079,777 | 1/1992 | Fowler et al. | 2/50 |
| 5,100,710 | 3/1992 | Rizzuto | 428/43 |
| 5,432,952 | 7/1995 | Tate | 2/49.4 |
| 5,469,580 | 11/1995 | Sobol | 2/50 |
| 5,483,701 | 1/1996 | Ferreyros | 2/49.2 |
| 5,490,289 | 2/1996 | Lehrer | 2/49.2 |
| 5,491,844 | 2/1996 | Kehl et al. | 2/49.1 |
| 5,509,141 | 4/1996 | Saltzman | 2/49.2 |
| 5,530,968 | 7/1996 | Crockett | 2/46 |
| 5,621,916 | 4/1997 | Bell | 2/48 |
| 5,625,897 | 5/1997 | Park | 2/69 |
| 5,640,715 | 6/1997 | Adams | 2/46 |
| 5,640,716 | 6/1997 | Oldham | 2/49.1 |
| 5,644,793 | 7/1997 | Lahaussois et al. | 2/59 |
| 5,651,140 | 7/1997 | Gibson | 2/46 |
| 5,661,851 | 9/1997 | Sanchez | 2/49.4 |
| 5,669,770 | 9/1997 | Fisher et al. | 433/137 |
| 5,672,056 | 9/1997 | Fisher et al. | 433/137 |
| 5,673,433 | 10/1997 | Rothrum | 2/46 |
| 5,694,646 | 12/1997 | Roberts | 2/114 |
| 5,701,605 | 12/1997 | Bowen | 2/49.1 |
| 5,715,542 | 2/1998 | Reinhart | 2/49.1 |
| 5,802,811 | 9/1998 | Danzig . | |
| 5,809,568 | 9/1998 | Morris-Jones . | |

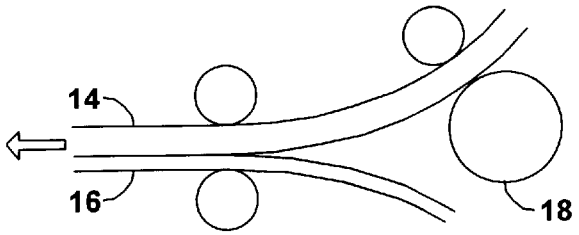
FIG. 1-A
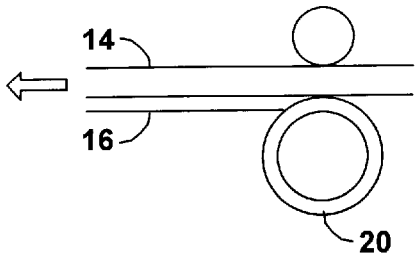
FIG. 1-B
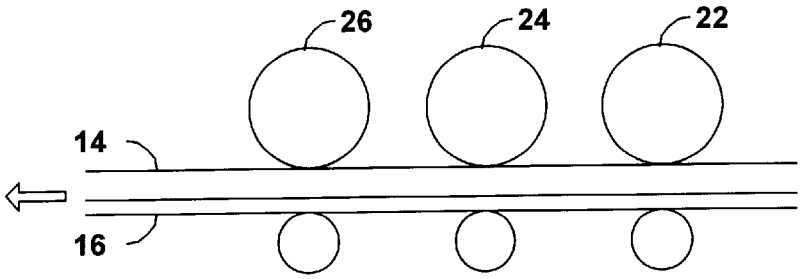
FIG. 2
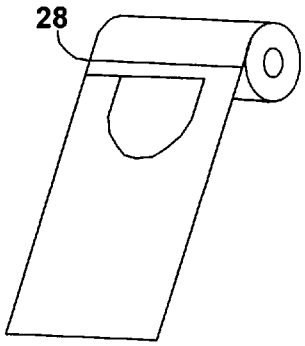
FIG. 3
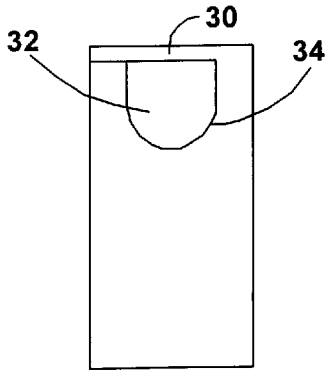
FIG. 4

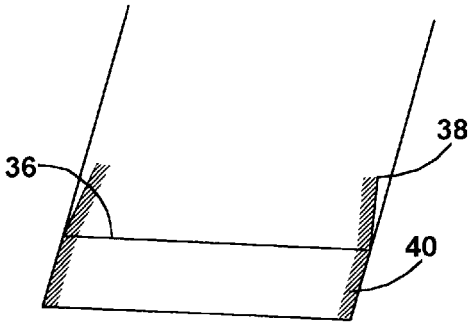
FIG. 5-A
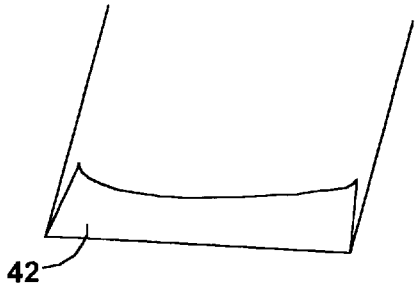
FIG. 5-B
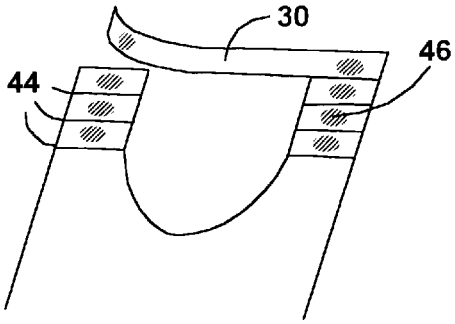
FIG. 6-A
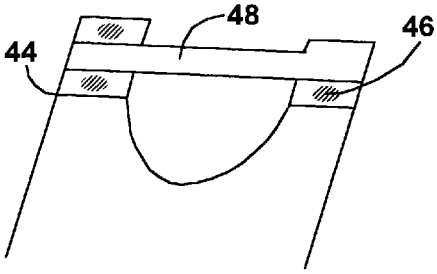
FIG. 6-B
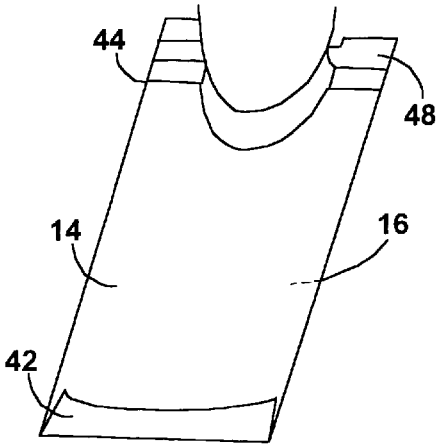
FIG. 7

ADJUSTABLE REUSABLE DISPOSABLE BIB

BACKGROUND—CROSS-REFERENCE TO RELATED APPLICATION

Provisional Application No. 60/042,657 dated Apr. 4, 1997.

BACKGROUND—FIELD OF THE INVENTION

This invention relates to garment protectors, specifically disposable bibs that protect the wearer's clothing from liquid and solid spills.

BACKGROUND—PRIOR ART

Clearly, there is a need to protect clothing in eating-related situations including: infants being bottle fed, infants and children feeding themselves, people cooking, people eating greasy food at home and dining out, people eating in vehicles and airplanes, senior citizens that have difficulty eating and people eating or being fed while in bed. There is also a need for protection in dental, medical, personal care and industrial situations.

With some exceptions, "permanent" bibs are not practical for casual clothing protection. They cost too much, can become unsanitary, require regular cleaning and their heavier material makes them less comfortable to wear.

Disposable bibs are obviously the solution. However, given all these needs, why do we not see disposable bibs in use everywhere and particularly in the home? The answer has to be that disposable bib inventions have not yet met the minimum criteria necessary for a bib to become a commercial success. While prior inventions have clever features, it seems that no inventor has given enough thought to what it takes to have a successful consumer product.

I feel the criteria that must be met are as follows:

(a) A manufacturer must be willing to produce and promote the bib. For this to happen there must be the potential of a large and profitable market. The sales and profit will be there if the manufacturer can deliver an effective, inexpensive product that does not cost too much to make. Thus, the product must be made from common, inexpensive, preferably recycled materials and the product must be produced, packaged and distributed using existing equipment, facilities and distribution channels as much as possible.

(b) Retailers such as supermarkets (the best location for purchasing convenience) must be willing to stock the bib. This will happen only if there is a large market, an attractive mark-up and the product comes from a reliable supplier in convenient, familiar packaging.

(c) Consumers must feel that the bib packaging is a familiar size, it is convenient to buy and it dispenses bibs easily.

(d) Consumers must also feel that the bib prevents staining, fits well, is comfortable to wear and is easy to attach, detach and reuse.

(e) Furthermore, consumers must feel the bib is a good value. This will happen if the bib is inexpensive to produce (resulting in a low sales price) and the bib can be reused as needed.

If consumers find a bib that meets their needs and is economical, there will be a large demand for the product. A proper design will ensure that such a bib can be made at a low cost. This will generate manufacturer and retailer interest.

I personally reviewed over 250 bib patents using an APS-CSIR workstation. None met the performance and production cost criteria just described. Some suggested materials that would be too expensive. Some suggested materials did not have the desired characteristics of an absorbent top surface and a moisture barrier next to the wearer. Some had odd shapes that would generate scrap and raise the production cost. Many had add-on pieces like snaps, attachment pads, adhesive strips, stitching, etc. that would increase the production cost. Some neglected to incorporate an effective, inexpensive pocket at the bottom of the bib to catch and retain spills. Some designs could not be reused repeatedly, which greatly increases the per-use cost of a bib.

The greatest design weakness was the lack of an easy, low cost, effective means of fitting the bib to various neck sizes, adjusting the closeness of fit and reusing the attachment. While many looked good on paper, testing proved that the designs were impractical. Mechanical attachments are too costly. Integral straps are difficult to tie and untie and posed a choking hazard while attached. Adhesives applied to both surfaces of the material can cause one bib to stick to another while the bibs are on a roll or in a stack. Adhesives applied to just one surface which is then pressed against a non-adhesive surface does not work either. To adhere, the adhesive must be very tacky, again creating the problem of one bib sticking to another. Furthermore, the required tackiness makes it difficult to pull-apart the connection for reused. Other attachment designs did not seem suitable for repeated reuse of the bib. A sample of the patents reviewed accompanies this application.

OBJECTS AND ADVANTAGES

Accordingly, several objects and advantages of my invention that will ensure the lowest cost of manufacturing and distribution are:

(a) common, inexpensive, recycled materials can be used (b) there is no wasted material during production (c) one size fits both children and adults—no need for multiple sizes (d) there are no added parts like buttons, snaps, attachment pads, stitching or ties (e) there are no additional production operations—all the production operations can be done in a continuous manner at the same time (f) adhesives for attachment are applied to just one side of the material so the cost is lower and bibs do not stick tightly to each other during production, packaging and shipping—the bib's attachment process is adhesive-area-to-adhesive-area so the applied adhesive areas are not tacky by themselves)

(g) the bib is sized to be produced and packaged on existing types of production equipment and facilities (h) the bib packages will be compatible with existing distribution and retailing systems, facilities and channels Furthermore, several objects and advantages of my invention that will ensure the highest bib performance and consumer satisfaction are:

(a) the bib and its proposed packaging are designed specifically to fit standard holders, thus making the bibs easy to store and dispense (b) one size fits both children and adults—one size fits the whole family (c) the bib material has the desirable moisture absorbing top surface and moisture barrier bottom surface (d) a special folding and attachment process forms an effective pocket at the bottom of the bib to catch debris and liquids and retain them (e) the attachment means at the neck is adjustable for neck size (f) the attachment means at the neck is adjustable for closeness of fit—a very important feature because this enables the bib to catch those spills that otherwise would run down the wearer's neck (g) the attachment means at the neck is easy to attach and detach, allowing for repeated use of the bib and eliminating the choking hazard associated with ties, high-tack adhesives and mechanical attachments (h) all attachments are made by folding adhesive areas over onto themselves and applying pressure—so the adhesive areas by themselves before fold-over are not "sticky"

Other objects and advantages are (a) the same attachment process used for a custom neck fit can be used to shorten the bib (b) the same attachment process used for a custom neck fit for standard bibs can be used to attach wider bibs (shoulder protecting) and longer bibs (back protecting)

(c) the material removed to make the neck hole makes an effective wiping rag (d) the preferred bib material is more effective than a paper towel for general purpose wiping (e) the bib as an unfolded sheet of material with the neck hole material left in place makes an effective napkin for lap protection and an effective "burp cloth" for feeding infants Further objects and advantages of my invention will become apparent from a consideration of the drawings and ensuing description.

DRAWING FIGURES

In the drawings, closely related figures have the same number but different alphabetic suffixes.

FIGS. 1-A and 1-B show two methods for making bib material

FIG. 2 shows bib material being printed, having adhesive applied and being perforated FIG. 3 shows a bib supplied on a continuous roll, ready to be separated at a perforation FIG. 4 shows a bib removed from a roll, before the neckband is separated at its perforation and before the neck hole material is removed. (This is what a bib taken from a package of individual sheets would look like.)

FIGS. 5-A and 5-B show the bottom of a bib before and after folding to form a pocket FIG. 6-A shows the top of a bib after the neckband has been separated and after the neck hole material has been removed FIG. 6-B shows the top of a bib after the neckband has been placed around the user's neck and folded-over so that the adhesive areas make contact (a middle neck fit position has been selected in the drawing)

FIG. 7 shows a bib on a user

Figure 9:
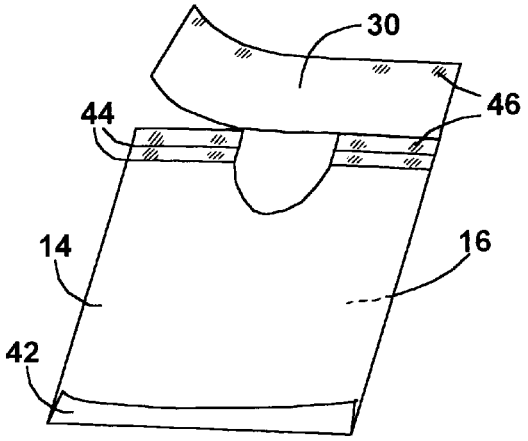
Figure 10:
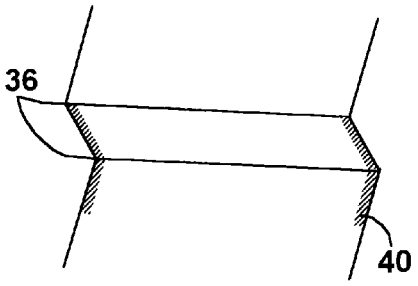
Figure 11:
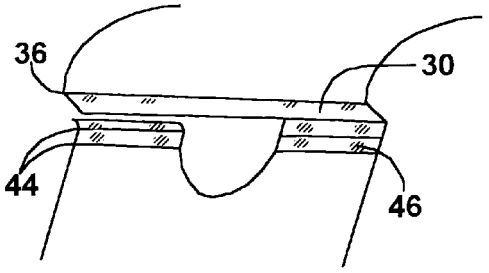

FIG. 8 shows an embodiment appropriate for bottle-fed infants—the same type of construction but a much narrower and shorter bib without a pocket FIG. 9 shows an embodiment to protect the shoulder area too—the same type of construction but a much wider bib FIG. 10 shows an embodiment for shortening a bib by folding and pressing together "permanent" adhesive areas FIG. 11 shows an embodiment to protect the back of the wearer too—using the same fold-over type of construction as with FIG. 10 except that the fold-over strip is a neckband, the adhesive used is releasable and the bib has a much longer behind-the-neck area than the wide bib shown in FIG. 9

Figure 12:
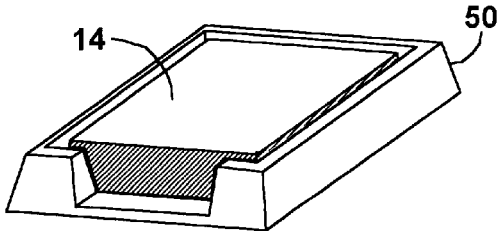

FIG. 12 shows an embodiment whereby a counter-top dispenser holds hand-sized sheets of bib material—to be used for wiping and clean up

REFERENCE NUMERALS IN DRAWINGS

| | | | |
|---|---|---|---|
| 14 | absorbent material | 16 | moisture barrier |
| 18 | lamination adhesive | 20 | roller or drum |
| 22 | printing drum | 24 | adhesive drum |
| 26 | perforation roller or drum | 28 | bib separation perforation |
| 30 | neckband | 32 | neck hole material |
| 34 | neckband and neck hole perforation | 36 | fold line |
| 38 | pocket attachment guidelines | 40 | "permanent" attachment adhesive |
| 42 | pocket formed by folding | 44 | neckband attachment guidelines for desired fit |
| 46 | releasable adhesive | 18a | adhesive drum |
| 50 | counter-top dispenser for wiping sheets | 26a | perforation process |

SUMMARY OF THE INVENTION

In accordance with the present invention, an adjustable, reusable, disposable bib comprises a rectangular shape of material having a liquid-absorbing top surface and a moisture barrier backing, neck hole material that is removed and retained for wiping, a fold-up bottom flap attached in a manner that forms a protruding pocket, and a fold-over neckband, enabling the bib to be attached easily, to be custom-fitted to the user's neck size and desired closeness of fit, to be detached easily and reattached as needed. A close neck fit catches spills running down the face. One size fits all, thereby reducing manufacturing and retailing costs and adding to consumer convenience.

The bib was specifically designed to be produced from common, inexpensive, recycled materials such as paper toweling bonded to consumer-grade plastic film. Furthermore, it was designed to be produced, packaged, distributed and retailed in a roll like paper towels are packaged, with the same roll diameter and eleven-inch width as a roll of paper towels. Thus, it can be produced using existing paper towel production and distribution facilities. Furthermore, consumers will be able to use standard paper towel holders to hold the roll of bibs and dispense bibs in a tear-off manner as they do with paper towels.

DESCRIPTION—FIGS. 1 to 4

In the preferred embodiment, a bib is made from material with an absorbent top surface and a moisture barrier bottom surface. FIG. 1-A shows the making of the dual-purpose material by joining an absorbent material 14 to a moisture barrier material 16 using a lamination adhesive 18. The adhesive is applied with a roller(s) or drum 18*a* as shown or by spraying. FIG. 1-B shows an alternative method by which a moisture barrier coating 16 is applied to a bottom surface of an absorbent material 14 using a roller(s) or drum 20 as shown or a spraying process.

FIG. 2 shows three operations performed on the bib material after it is made. These could be done in a continuous sequence immediately following the making of bib material (see FIGS. 1-A and 1-B) or as a separate sequence of operations performed later on a roll of bib material. Process 22*a* represents the printing of folding and attachment guidelines (see 36 and 38 on FIG. 5-A and 44 on FIGS. 6-A and 6-B) and the printing of a pattern and/or advertising. This could be done with an inked roller(s) or drum 22 as shown or using an ink spraying process. Process 24*a* represents the application of an adhesive for a fold-up pocket (see 40 on FIG. 5-A) and the application of an adhesive used to attach the neckband (see 46 on FIG. 6-A). This could be done with an adhesive roller(s) or drum 24 as shown or a spray process. Process 26*a* represents the perforation of the material to facilitate removing a bib from the roll (see 28 on FIG. 3), separating the neckband and removing the neck hole material (see 34 on FIG. 4). This is done with cutters, dies or punches attached to a roller(s) or drum 26 as shown. When bibs are supplied as individual sheets, the perforation operation 26 that makes the bib removal perforation (see 28 on FIG. 3) would be replaced with a cut-off operation.

FIG. 3 shows how bibs would appear when supplied on a continuous roll. The roll has perforations 28 for easy removal of a bib.

FIG. 4 shows a bib after it has been removed from a roll. The bib has perforations 34 for separating the right side of the neckband 30 and removing the neck hole material 32. FIG. 4 also shows how a bib would appear if bibs are supplied as individual sheets instead of being on a roll.

OPERATION—FIGS. 3 to 7

FIG. 3: First, a bib is removed from a roll by tearing along the perforation 28.

FIG. 4: Then, a neckband 30 is separated along its perforation 34. That same perforation 34 is used to remove the neck hole material 32. The neck hole material is retained because it makes an excellent "wash cloth" for wiping the face and spills. (See Ramifications for the material's use as a separate invention.)

FIGS. 5-A and 5-B: Then, the bottom of a bib is folded up along line 36 to make a pocket 42. Printed guidelines 38 show where the ends of the folded-up portion should be attached. The inward facing guidelines cause the folded-up portion to bulge outwards, forming a pocket. The pocket is held in place by pressing each end of the folded-up portion where adhesive 40 has been pre-applied to the adhesive areas on the bib above the fold line. The pocket is designed to catch and retain liquid and solid spills.

FIGS. 6-A and 6-B: Then, a bib is placed around the wearer's neck. The neckband 30 is folded over behind the wearer's neck and attached on both sides of the bib at one of several attachment points 44. A range of attachment points provides a custom fit to a wearer's neck size and allows for adjusting the tightness around the neck. The attachment is accomplished by pressing together pre-applied adhesive areas 46 on either side of the bib. This attachment method is easy to put on, easy to take off and easy to reuse.

FIG. 6-B: A bib is removed from the wearer by gently pulling apart where the neckband 30 is attached at the right shoulder. The reusable adhesive 46 allows a release without having to tear the neckband. This adhesive also allows a bib to be reused as often as desired by repeating the attachment process described above. Only the right side of the neckband needs to be detached and reattached for bib removal and reuse. This attachment method releases easily for safety purposes.

FIG. 7: This shows the typical use of the invention. A top surface 14 absorbs liquid drips and spills. A bottom surface 16 next to the wearer prevents liquids from penetrating the bib and soiling the wearer's clothing. A pocket 42 at the bottom catches and retains liquid and solid spills. A neckband 30 at the bib's top keeps the bib in place. An adjustable feature, namely a range of possible attachment points 44, allows for a custom fit at a neck ranging from loose to snug and accommodates different neck sizes.

CONCLUSION, RAMIFICATIONS (FIGS. 8 TO 12) AND SCOPE

Accordingly, this invention seems to have every feature that bib users and manufacturers have been waiting for. A dual surface material absorbs liquids that could otherwise run off while at the same time preventing those liquids from reaching the wearer's clothing. The preferred type and size of material to be used and the design ensure that a bib can be produced at a low cost, comparable to the cost of paper toweling. Even though low in cost, the bib has high performance features. It provides a pocket to catch spills and allows a range of neck adjustments to give a custom fit. It allows a close fit to catch spills down the face. The material removed to make a neck hole is useful for wiping faces, hands and surfaces. The bib is easy to put on and take off and it can be reused. Easy removal is also a safety feature, avoiding the hazards of bibs that have straps or strings that are tied. One size fits all for low cost and convenience.

Furthermore, the material and design have broader applications, including:

FIG. 8: One ramification is a bib suitable for use for bottle-feeding infants. It uses the same material and attachment mechanism but a narrower and shorter size without a fold-up pocket. As a replacement for cloth bibs, this disposable bib has many advantages. A cloth bib gets stiff after being wet with liquid and loses its absorbency. Also, a cloth bib can smell and become a breeding ground for bacteria with repeated reuse. Frequent laundering is required. The invented bib can be discarded as needed because of its low cost. It is designed to be disposable when soiled. Also, this invention does not require strings or straps to be tied around an infant's neck. Strings and straps are harder to tie, even harder to remove and pose a strangulation hazard.

FIG. 9: Another ramification is to use the same material and attachment mechanism but a wider and slightly longer size to cover the shoulder area and the area immediately behind the wearers neck. The wider size is useful for various dental, medical, personal care and hair treatment applications. The neckband 30 will be wider in this application to provide more behind-the-neck coverage after fold-over and attachment.

FIG. 10: If a bib-shortening feature is desired, this can be done by using the same technique of folding 36 and pressing together surfaces having a pre-applied adhesive 40. Two folds, forward to attach the adhesive areas and backward to return to the original position, are made as shown.

FIG. 11: The fold-over technique described above for FIG. 10 is also suitable for attaching bids that have a large area behind the neck. As shown, the folded-over portion is also a neckband 30 in this application. The long bib can be fold-over and attached at various points 44 to give different neck fits. However, unlike the bib shortening application (see FIG. 10), a reusable adhesive 46 is used to enable the bib to be taken apart easily and reused.

FIG. 12: Another ramification concerns the discarded neck hole material (see 32 on FIG. 4). With its absorbent surface 14 and moisture barrier backing 16 (not shown on FIG. 12), this material makes a very effective wiping cloth for both liquids and solids. This material is a very important embodiment by itself. Rectangular pieces of this material, approximately 5.5 inches wide (half the width of paper toweling) were useful and effective, wetted or dry, as a wiping cloth. The wiping pieces can substitute for wash cloths, dish rags, paper toweling and sponges for minor clean-ups. With its moisture barrier backing, the material was more resistant to going limp when wet than paper toweling. For counter-top convenience, a blow molded or injection molded plastic holder 50 is suggested.

Another ramification is the use of an unfolded bib with the neck hole material in place (see FIG. 4), or similar size of bib material, as a napkin for the lap. It provides broad coverage, does not slide off the lap and prevents liquid spills from penetrating the material and staining clothing.

Another ramification is the use of an unfolded bib with the neck hole material in place (see FIG. 4), or similar size of bib material, as a "burp pad" while feeding infants. It bends easily, provides broad coverage, does not slide off the lap or shoulder and prevents liquid spills from penetrating the material and staining clothing.

Although the description above contains many specificities, these should not be construed as limiting the scope of the invention but as merely providing illustrations of some of the presently preferred embodiments of this invention. For example, a bib can have other widths and shapes as needed for specific applications. Also, there may be applications where other materials would be more appropriate.

Thus, the scope of the invention should be determined by the claims and their legal equivalents, rather than by the examples given.

I claim:

1. A protective wearable covering composed of a sheet of flexible material being sized so as to cover the upper torso of a wearer to protect a wearer's skin or clothing, comprising:

a body with a bottom edge, a top edge, and first and second sides;

perforations spaced down from said top edge and extending parallel to said top edge from said first side toward said second side and ending at a point spaced inwardly from said second side thus defining a neckband which, when said perforations are broken, is unattached to the covering at said first side and attached to said covering at said second side;

additional perforations extending from said point spaced inwardly from said second side in U-shape to form a neck hole in said protective covering when said additional perforations are broken;

a plurality of individual attachment points spaced adjacent both the first and second sides wherein said neckband can be folded for selective attachment to respective ones of said plurality of attachment points on said first side and said second side allowing for adjustable securement of the covering about the neck of a wearer.

2. The protective covering of claim 1 wherein said plurality of individual attachment points includes adhesive.

3. The protective covering of claim 1 wherein said flexible material includes a liquid absorbent front surface material.

4. The protective covering of claim 1 wherein said flexible material includes a liquid repellent back surface material.

5. The protective covering of claim 3 wherein said flexible material further includes a liquid repellent back surface material.

6. The protective covering of claim 3 wherein said front surface material comprises one or more layers of paper.

7. The protective covering of claim 4 wherein said back surface material comprises a plastic film.

8. The protective covering of claim 1 wherein said flexible material comprises paper treated with a liquid repellent material on one side.

9. The protective covering of claim 1 further comprising a fold line parallel to and spaced from said bottom edge;

printed guidelines extending adjacent both said first side and said second side, said guidelines extending diagonally inward beginning at said fold line and extending above said fold line;

adhesive located along said first side and said second side, said adhesive extending from said fold line downwardly wherein said bottom edge can be folded along said fold line such that adhesive is attached to a front surface of said covering at said printed guidelines to form a pocket having an open mouth.

10. The protective covering of claim 9 wherein said adhesive is further located diagonally upwardly from said fold line along said printed guidelines.

11. The protective covering of claim 1 wherein individual coverings are dispensed from a roll of continuous coverings, said coverings being separable by a perforation.

12. The protective coverings of claim 1 wherein said coverings are dispensed individually from a holding means.

13. The protective covering of claim 1 wherein said covering has a design on a front side.

14. The protective covering of claim 1 wherein material removed from the cover to form said neck hole can be used as a wipe.

* * * * *

UNITED STATES PATENT AND TRADEMARK OFFICE

CERTIFICATE OF CORRECTION

PATENT NO. : 5,930,836
DATED : August 3, 1999
INVENTOR(S) : Morris, Bert W.

It is certified that error appears in the above-identified patent and that said Letters Patent is hereby corrected as shown below:

Showing an illustrative figure, should be deleted and substitute therefor the attached title page.

Delete the drawing sheets 1 and 2, and substitute therefor the Drawing Sheets, consisting of Figures 1-A, 1-B, Figures 2, 3, 4, 5-A, 5-B, 6-A, 6-B and 7, as shown on attached pages.

Columns 3 and 4,
Reference Numerals in Drawings, after "26a perforation process" insert new line
-- 22a printing process 24a adhesive process --

Signed and Sealed this

Twenty-ninth Day of April, 2003

JAMES E. ROGAN
*Director of the United States Patent and Trademark Office*

United States Patent [19]

Morris

[11] Patent Number: 5,930,836

[45] Date of Patent: Aug. 3, 1999

[54] ADJUSTABLE REUSABLE DISPOSABLE BIB

[76] Inventor: Bert Morris, 465 La Corso Cir., Walnut Creek, Calif. 94598-2237

[21] Appl. No.: 09/055,066

[22] Filed: Apr. 3, 1998

Related U.S. Application Data

[60] Provisional application No. 60/042,657, Apr. 4, 1997.

[51] Int. Cl.[6] ..... A41B 13/00; A41B 13/10

[52] U.S. Cl. ..... 2/49.1; 2/49.2; 2/52

[58] Field of Search ..... 2/48, 49.1, 49.2, 2/49.3, 49.4, 49.5, 50, 51, 52

[56] References Cited

U.S. PATENT DOCUMENTS

| | | | |
|---|---|---|---|
| D.,232,134 | 7/1974 | Andersson . | |
| 1,898,950 | 2/1933 | Goldberger . | |
| 2,763,867 | 9/1956 | Chagnon . | |
| 2,782,420 | 2/1957 | Barager . | |
| 3,001,646 | 9/1961 | Cooper | 206/58 |
| 3,146,465 | 9/1964 | Hummel . | |
| 3,328,807 | 7/1967 | Strauss | 2/49 |
| 3,332,547 | 7/1967 | Rowe et al. . | |
| 3,416,157 | 12/1968 | Marder et al. | 2/49 |
| 3,452,363 | 7/1969 | Schultz | 2/49 |
| 3,857,116 | 12/1974 | Meeker | 2/50 |
| 3,945,048 | 3/1976 | Shearer | 2/49 |
| 3,979,776 | 9/1976 | Gruenwald | 2/49 |
| 3,995,321 | 12/1976 | Johnson | 2/49 |
| 3,999,221 | 12/1976 | Hannigan | 2/49 |
| 4,038,697 | 8/1977 | Levitt | 2/49 |
| 4,114,199 | 9/1978 | Malan | 2/49 |
| 4,171,542 | 10/1979 | Cox et al. | 2/51 |
| 4,186,443 | 2/1980 | Britzman | 2/49 |
| 4,225,977 | 10/1980 | Smith . | |
| 4,233,688 | 11/1980 | Hjerl . | |
| 4,261,057 | 4/1981 | Andersson | 2/49 |
| 4,288,877 | 9/1981 | Klepfer | 2/48 |
| 4,306,316 | 12/1981 | Klepfer | 2/48 |
| 4,330,888 | 5/1982 | Klepfer | 2/48 |
| 4,416,025 | 11/1983 | Moret et al. | 2/49 |
| 4,423,523 | 1/1984 | Bodner et al. | 2/49 |
| 4,441,212 | 4/1984 | Ahr et al. | 2/49 |
| 4,442,552 | 4/1984 | Bolick et al. | 2/49 |
| 4,445,231 | 5/1984 | Noel | 2/49 |
| 4,475,250 | 10/1984 | Savin et al. | 2/49 |
| 4,495,658 | 1/1985 | Moret et al. | 2/49 |
| 4,523,333 | 6/1985 | Spangler | 2/49 |
| 4,523,334 | 6/1985 | Lavash | 2/49 |
| 4,543,668 | 10/1985 | Franklin | 2/48 |
| 4,601,065 | 7/1986 | Sigl et al. | 2/49 |
| 4,620,323 | 11/1986 | Tepper | 2/49 |
| 4,622,698 | 11/1986 | Heyman et al. | 2/49 |
| 4,646,364 | 3/1987 | O'Larey . | |
| 4,646,365 | 3/1987 | Suprise et al. | 2/49 |
| 4,649,572 | 3/1987 | Roessler | 2/49 |
| 4,660,224 | 4/1987 | Ashcraft | 2/48 |
| 4,660,226 | 4/1987 | Quilling et al. | 2/49 |
| 4,706,303 | 11/1987 | Van Gompel et al. | 2/49 |
| 4,710,190 | 12/1987 | Wood et al. | 604/389 |
| 4,733,411 | 3/1988 | Foti | 2/49 |
| 4,754,500 | 7/1988 | Brucato et al. | 2/105 |
| 4,779,288 | 10/1988 | Mack | 2/49 |
| 4,780,911 | 11/1988 | Mack | 2/49 |
| 4,787,099 | 11/1988 | Mack | 2/49 |

(List continued on next page.)

*Primary Examiner*—John J. Calvert
*Assistant Examiner*—Shirra L. Jenkins

[57] ABSTRACT

This bib is designed to use the infrastructure already in place for the production, packaging, distribution, retailing and dispensing of a paper towel. A suggested bib material is a layer of paper toweling for absorbency with a plastic film backing for moisture protection. A suggested packaging is a roll of rectangular-shaped bibs having the same diameter and width as a roll of paper toweling. This enables the bib to be produced with existing technology and results in a roll of bibs that fits a standard paper towel holder and dispenses bibs in the same tear-off manner. The bib features a reusable attachment at the neck that accommodates different neck sizes and desired closeness of fit yet releases easily to eliminate a choking hazard. This also allows one size to fit children and adults. The bib also features a fold-up pocket at the bottom to catch and retain solid and liquid spills. These features plus the easy on, easy off and reusability add up to a low-cost, high performance product.

14 Claims, 3 Drawing Sheets

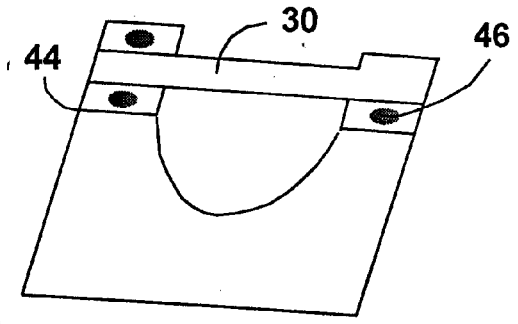

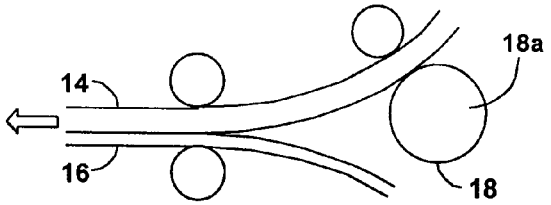
FIG. 1-A
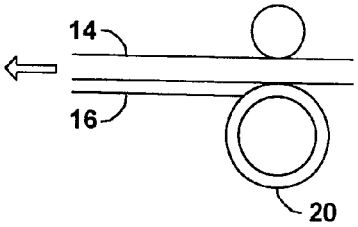
FIG. 1-B
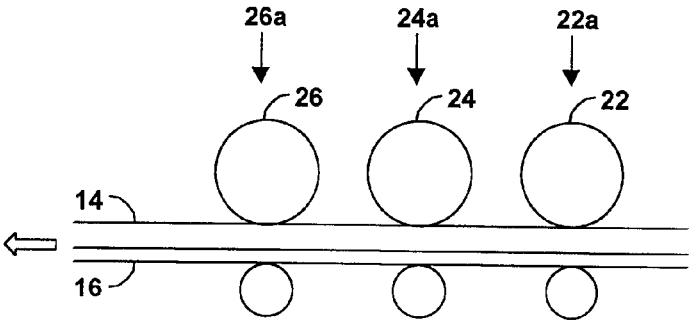
FIG. 2
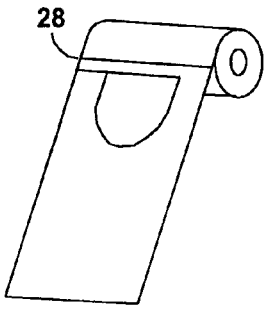
FIG. 3
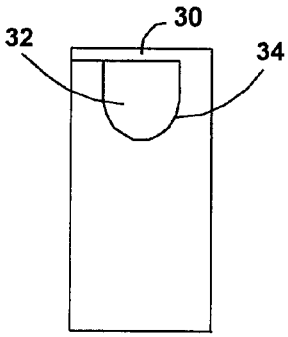
FIG. 4

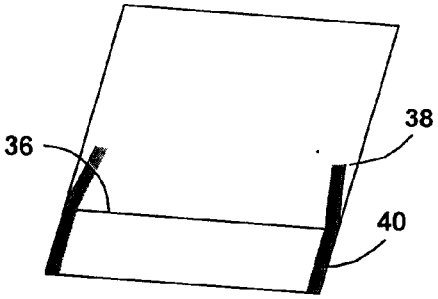
FIG. 5-A
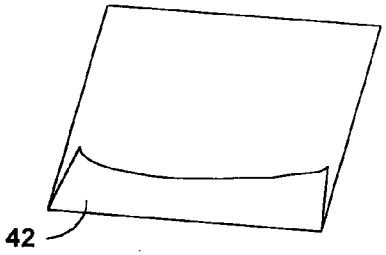
FIG. 5-B
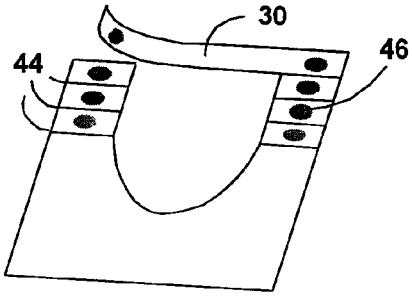
FIG. 6-A
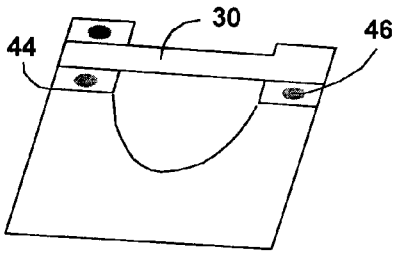
FIG. 6-B
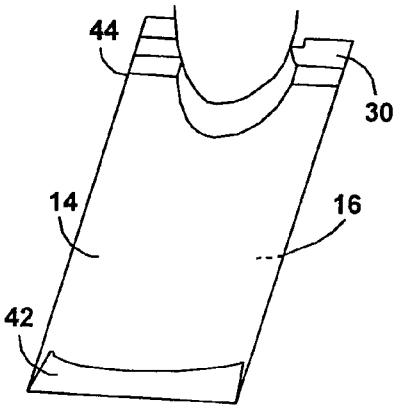
FIG. 7